United States Patent [19]

Charra

[11] Patent Number: 4,641,415

[45] Date of Patent: Feb. 10, 1987

[54] TOOL AND ATTACHMENT GRIPPING AND RELEASING MEANS

[75] Inventor: Jean-Pierre Charra, Saint Etienne, France

[73] Assignee: Berthiez-Saint-Etienne, France

[21] Appl. No.: 735,045

[22] Filed: May 17, 1985

[30] Foreign Application Priority Data

May 18, 1984 [FR] France ..... 84 07789

[51] Int. Cl.[4] ..... B23Q 3/157; B24B 45/00

[52] U.S. Cl. ..... 29/568; 51/168

[58] Field of Search ..... 29/568, 26 A; 51/168, 51/5 D, 262.7, 262 A

[56] References Cited

U.S. PATENT DOCUMENTS 3,627,490 12/1971 Asano ..... 51/168
4,084,349 4/1978 Farrell ..... 51/5 D
4,485,595 12/1984 Minamiyama et al. ..... 29/568 X
4,528,743 7/1985 Bleich ..... 29/568
4,551,902 11/1985 Thibaut ..... 29/568

*Primary Examiner*—William R. Briggs
*Attorney, Agent, or Firm*—Lalos, Keegan & Kaye

[57] ABSTRACT

Means for gripping and releasing tools and attachments used with a machine tool, especially a grinding machine equipped with a form grinding head, comprising a grinding wheel adaptor (22) a dresser roll cartridge (14) both provided with end compartments (25, 54) having a slot (35) adapted to be engaged by collet-type gripping apparatus (36) being part of maneuvering apparatus (37) also comprising a thrusting apparatus (40) adapted to selectively actuate locking apparatus (27) for the grinding wheel adaptor (22) on the spindle and locking apparatus for the dresser roll cartridge (14) on a movable support.

9 Claims, 6 Drawing Figures

38
37
46
47
48
47
44
45
40
49
39
41
36
35
23
25
34
22
10
9
33
50
36
43
42
32
24
30
31
29
26a
28
27
26

TOOL AND ATTACHMENT GRIPPING AND RELEASING MEANS

This invention concerns a means for gripping and releasing tools and attachments used with a machine tool, and in particular with a grinding machine.

Machine tool operations, particularly as concerns plunge grinders, commonly call for frequent changing of attachments and tools such as grinding wheels and dresser roll cartridges, making it necessary to automate the locking, unlocking and handling operations associated with such changeovers.

The form grinding of contours in particular requires frequent changing of grinding wheels to obtain different desired contours.

This grinding technique moreover demands frequent dressing of the grinding wheels themselves, such dressing being obtained with a diamond dresser or a suitably shaped dresser roll.

With the trend for more frequent contour changes, comes the need for faster dresser roll changeover devices.

Such rolls are now often loaded as preset cartridges which must be positioned and locked in place in a roll-holder cartridge support.

The present invention is directed to providing means for quickly and automatically gripping and releasing both the grinding wheel and the cartridge-type dresser roll.

In accordance with the invention, the grinding wheel adaptor or wheelhead and the cartridge are provided on one of their ends with a compartment or recess having a slot adapted to be engaged by a gripping collet of a maneuvering means also comprising a thrusting means operable to selectively actuate means for locking the wheelhead on the machine spindle and means for locking the dresser roll cartridge on a movable support.

The locking mechanism of the means according to the invention is built into the wellhead to avoid weakening the spindle carrying the grinding wheel. Depending upon the specifics of the machine-tool installation, said means can be actuated manually, or by a semi- or fully-automatic device such as a robot, or by a suitable tool handling apparatus.

Such an arrangement ensures secure handling of the element due to positive locking of the gripping means as well as to logical control of the various gripping and releasing steps.

Another advantageous feature of the invention is that the cylinder is given two inside chambers, one of which receives a first plunger both of whose faces are subjected to the action of a compressed fluid and the other of which receives a second plunger an end whereof projects beyond the cylinder, the inside of said second plunger having a blind hole therein, wherein the stem of the first plunger moves, with both the space between the head of the other chamber and the second plunger and the space within the blind hole filled with a hydraulic fluid.

This feature affords the possibility of equipping these machines with a dynamic balancing device for the wheel, usable with all the tools and coupling with them automatically during changeover.

Said feature enables coupling of the balancing device to the wheelhead to both rotatively drive and rigidly center the latter so as to enable it to transmit vibration-damping loads.

Moreover, in the means according to the invention, said balancing device is permanently attached to a fixed part of the machine, such that the tools are removed without having to dismantle said balancing device, said linkage being required to be vibration isolated so as not to adversely affect overall operation.

Other features and advantages of the invention will become apparent and will be more readily understood in reading the description hereinafter of several embodiments thereof with reference to the appended drawings in which.

Figure 6:
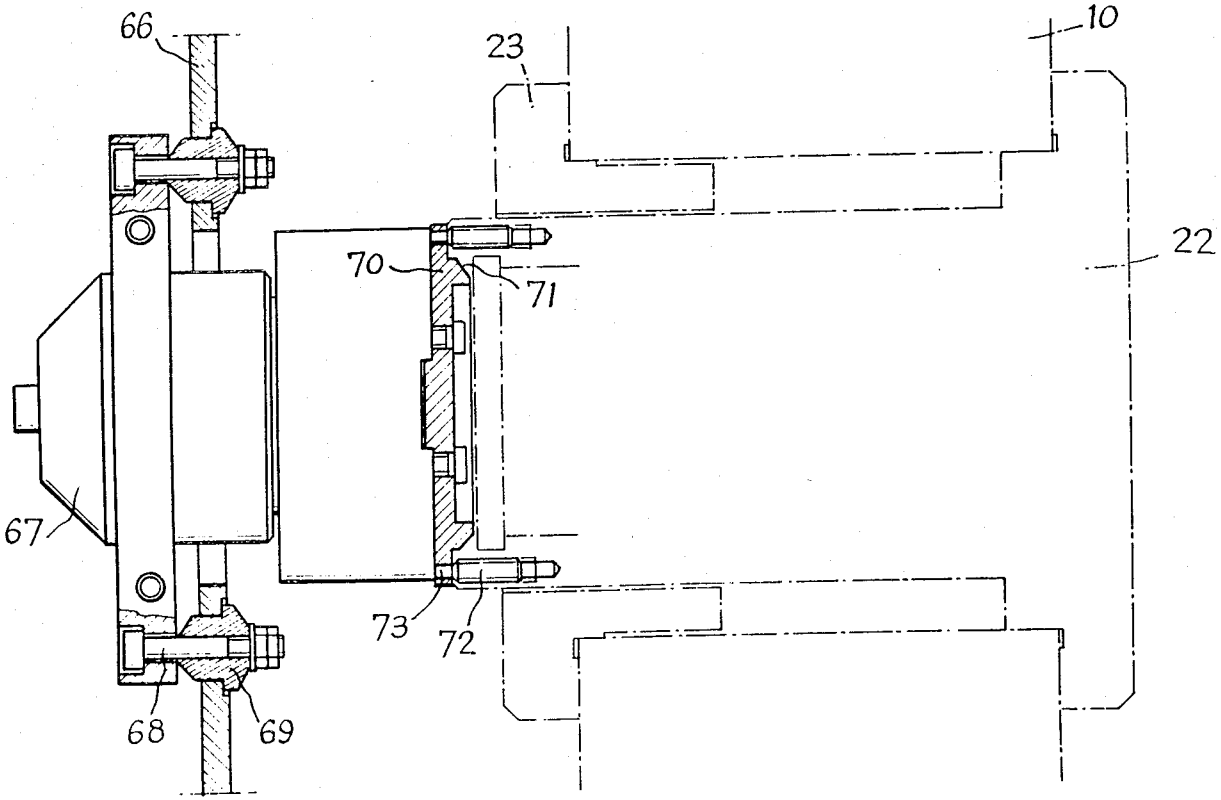

and FIG. 6 is an axial cutaway view of the wheel balancing device.

Figure 1:
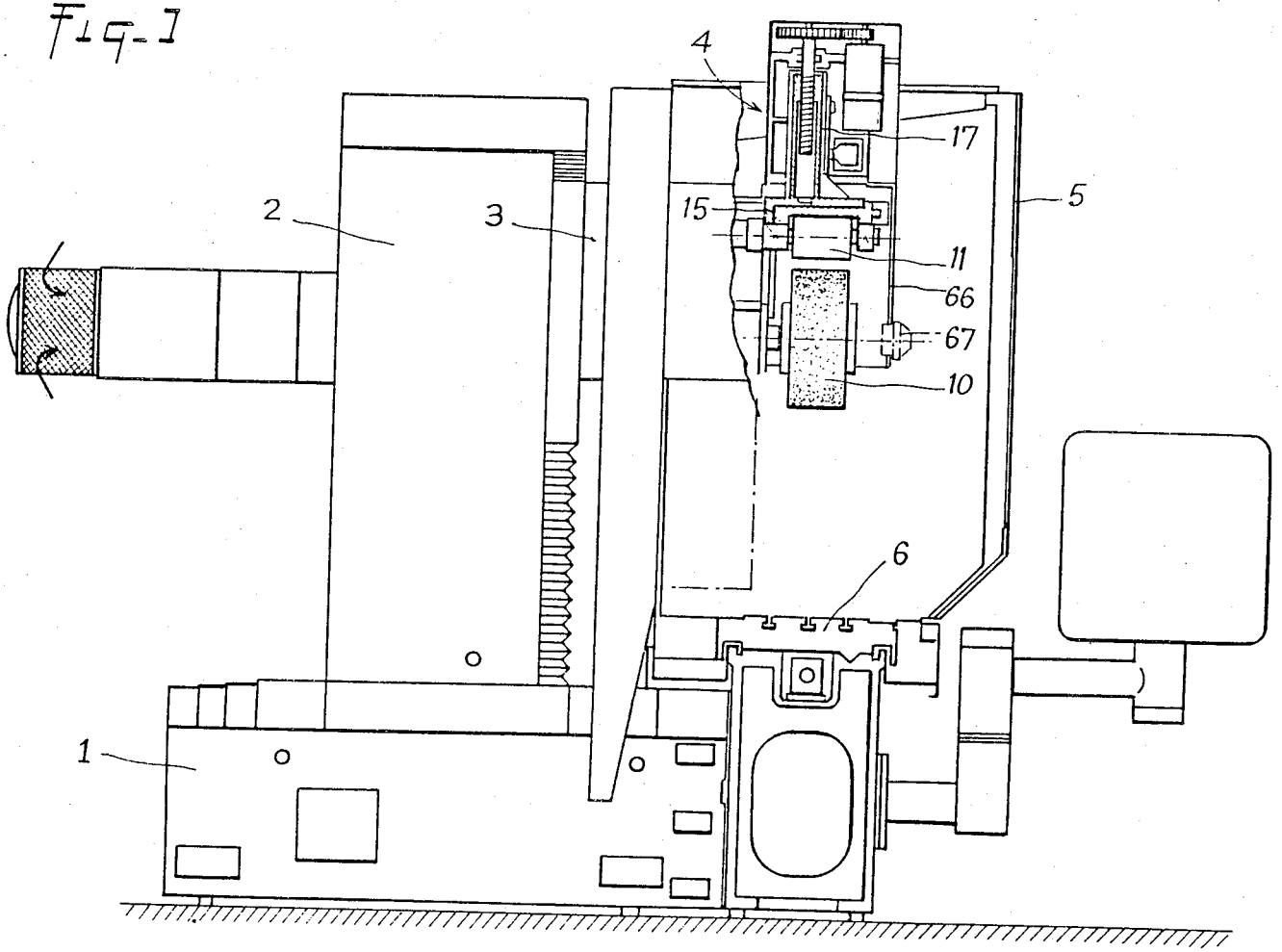
FIG. 1 is a side elevation of an improved grinding machine according to the invention.
Figure 2:
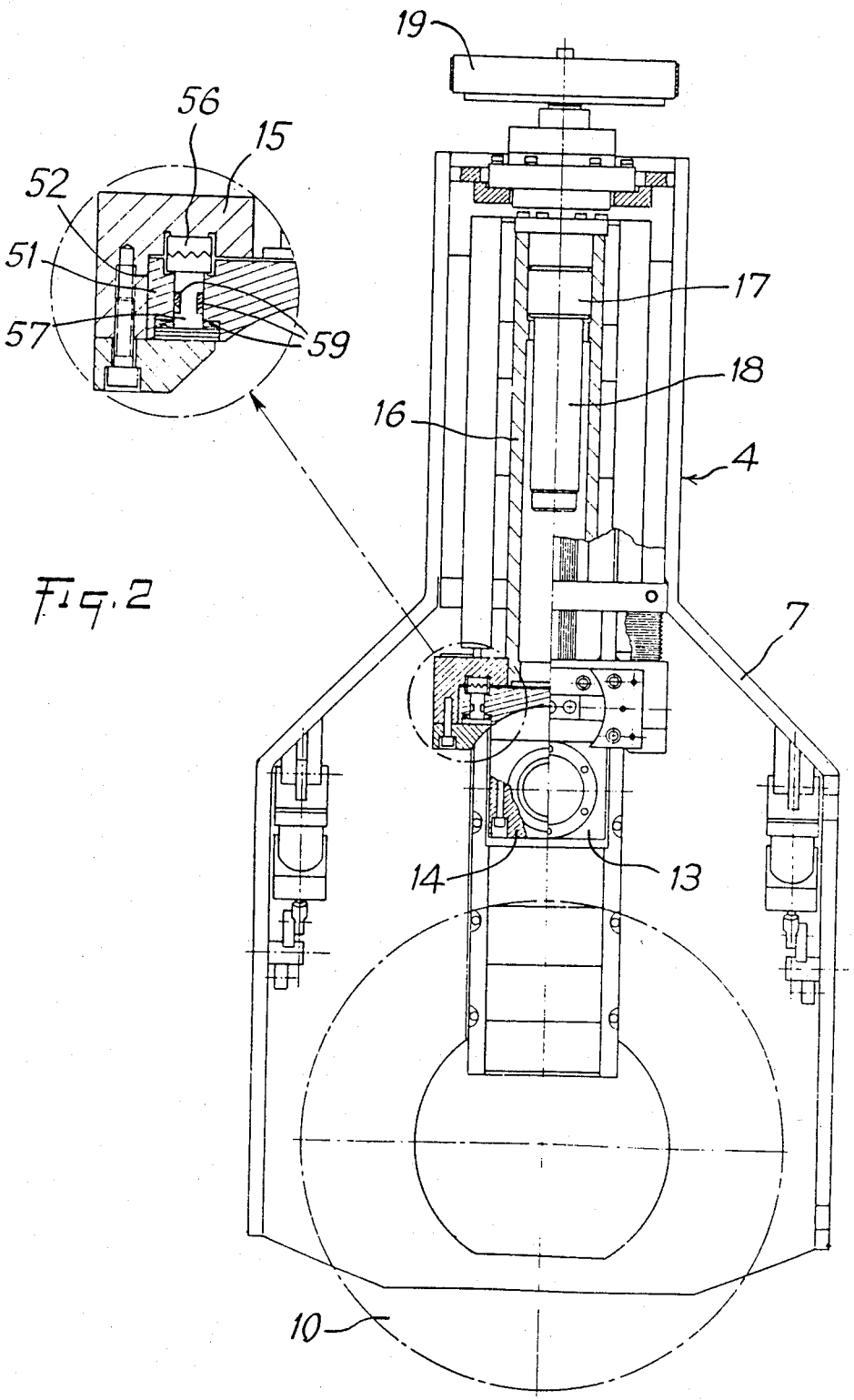
FIG. 2 is a front elevation and cutaway view of the machining head.
Figure 3:
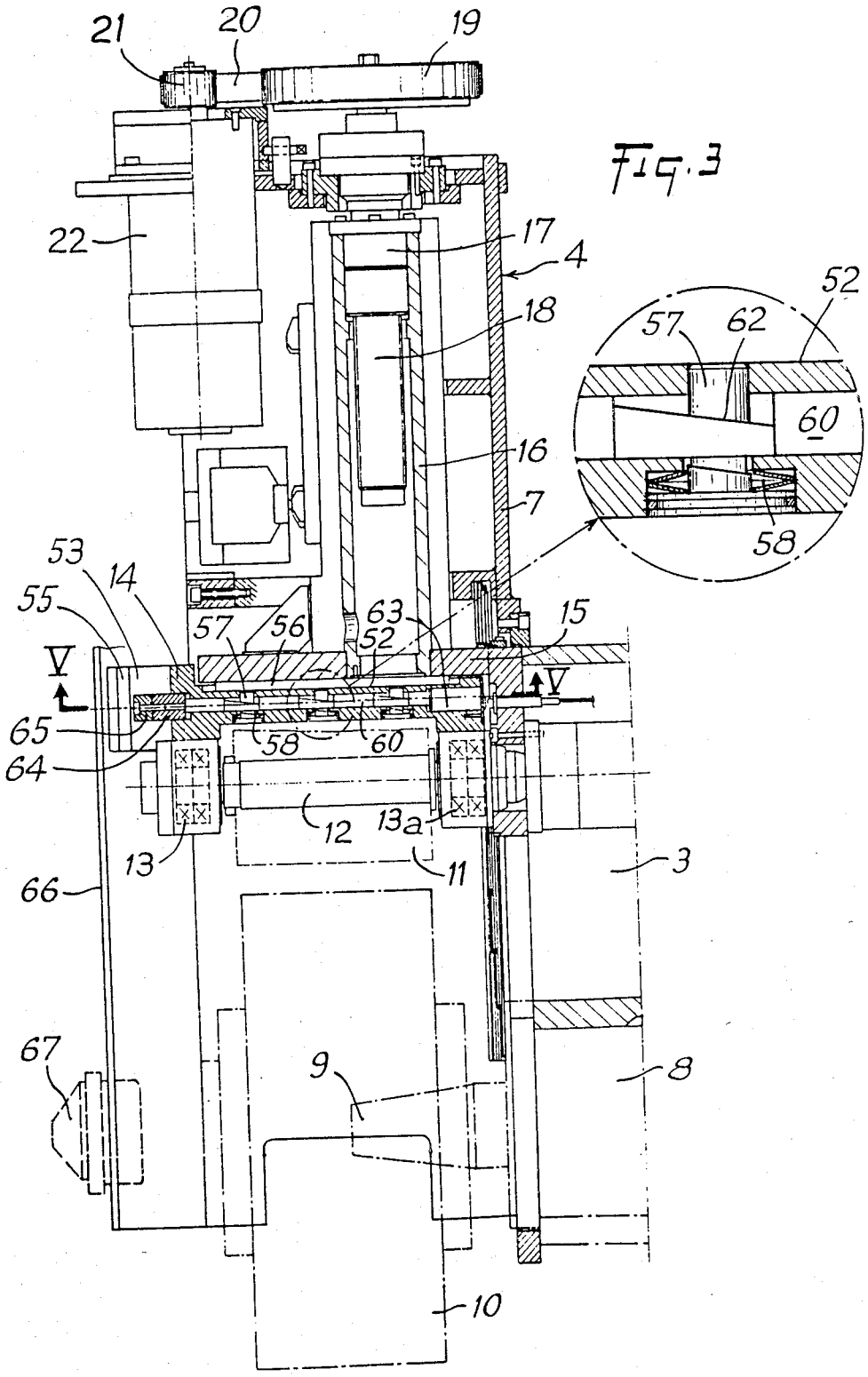
FIG. 3 is a side elevation and cutaway view of the same machining head.

As shown in FIG. 1, the grinding machine consists of a stand 1 on which is horizontally, slidably mounted a post 2 carrying a vertically moving machining head 3, one end whereof carries a profiling device 4 illustrated in greater detail in FIGS. 2 and 3. Said profiling device 4 moves within an enclosure 5 disposed above a machine table 6 designed to hold the workpiece.

Said profiling device 4 (FIGS. 2 and 3) comprises a frame 7 to the bottom whereof is attached a rotating spindle with a cone 9 having a grinding wheel 10 mounted thereon to grind the workpieces.

Above the wheel and parallel to its shaft is a rotatably mounted dresser roll 11 serving to dress wheel 10, said dresser 11 being mounted on a rotating shaft 12 by means of bearings 13, **13*a* in a cartridge 14, and said shaft 12** being coupled to a rotational driving means.

Cartridge 14 is removably mounted on a supporting arm 15 attached to the lower end of a tubular beam 16 the top whereof is provided with a nut 17 engaging with a ballscrew fitted with a pulley 19 linked by a timing belt 20 to another pulley 21 fitted to the end of the shaft of a driving means 22.

This arrangement enables vertical movement of the cartridge 14 and dresser roll 11, through the rotational driving of the ballscrew 18 and nut 17, to apply said roll to the grinding wheel 10 in view of dressing it, or to remove it therefrom.

Figure 4:
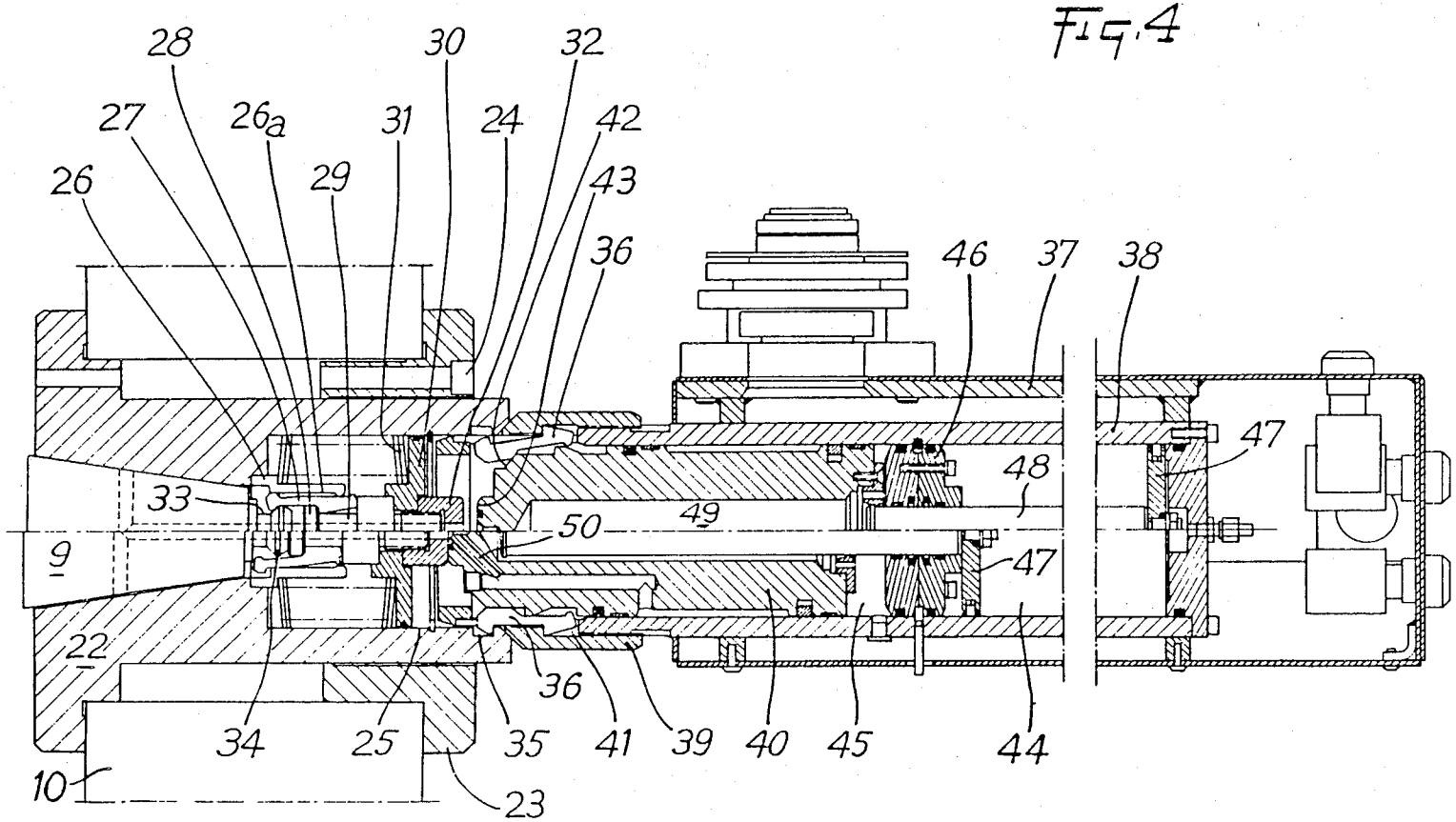
FIG. 4 is a longitudinal cutaway view of the wheelhead gripping and releasing means in the grinding head and in the maneuvering arm outside the machine, with the top half-view showing the wheel in mounted configuration and the bottom half-view showing the wheel being gripped or released.

As can be seen from FIG. 4, wheel 10 is fitted on spindle cone 9 via a wheelhead 22 and is clamped to said head by means of a retaining flange 23 and screws 24.

Wheelhead 22 features a bore 25 inside the bottom whereof is attached a sleeve 26 internally receiving the jaws or spring fingers of a collet means 27 engaged on an enlarged diameter part 28 at the end of a sliding rod 29 attached to a disk 30 slidably mounted in bore 25 and pushed by a stack of spring washers 31 the other side whereof bears against a shoulder in sleeve 26. The end of rod 29 towards the opening of bore 25 is fitted with an adjustable stop 32 designed to bear against a thrusting means.

The fingers of collet means 27 are urged by spring washers 31 and rod 29 into a neck 33 provided in a knob 34 on the end of driving cone 9. They are guided by a locking incline 26*a* formed on the inside of sleeve 26.

Near the opening of bore 25, a slot 35 is provided for engagement with the fingers of another gripping means 36 mounted on a maneuvering or tool changer means outside the machine.

Said maneuvering means consists of a moving arm 37 being for example part of a robot or a handling device, said arm 37 containing a cylinder actuator one end of the cylinder 38 secured therein whereof is fitted with a threaded collar 39 which, together with the end of a plunger 40 extrending beyond the end of said cylinder, bounds an annular space 41 wherein are mounted the fingers of gripping means 36 which are guided therein by an incline 42 on the end of plunger 40. Said plunger 40 also serves as the thrusting means or ram to drive collet means 27 when its end face 43 strikes the stop 32 attached to rod 29.

Cylinder 38 includes two chambers 44 and 45 separated by a sealing partition 46.

One of said chambers, 44, receives a first plunger 47 both of whose faces are subjected to the action of a compressed fluid, ie. of compressed air, for example.

Said first plunger 47 has a rod or stem 48 going through partition 46 and operable to extend into a blind bore 49 in a second plunger 40 sliding in the second chamber 45. The space between said second plunger 40 and partition 46 is filled with hydraulic fluid, as is the blind bore 49.

The operation of the wheelhead gripping and releasing means is as follows:

With the wheelhead 22 clamped to the knob 34 of spindle cone 9, as appears in the top half-view of FIG. 4, the fingers of collet means 27 are engaged in the neck portion 33 of said knob 34 by the action of spring washers 31 on said enlarged diameter part 28 of rod 29.

To release and remove the grinding wheel, the arm 37 of the maneuvering means must be moved towards the wheel as depicted in the top half-view of FIG. 4; as the first plunger 47 remains to the right, rod 48 is not engaged in the blind bore 49 of second plunger 40, which is pushed rightwards in chamber 45 of the cylinder. Gripping means 36 is in opened position to penetrate into bore 25 where it aligns with slot 35.

By driving the first plunger 47 leftwards, rod 48 slides into blind bore 49 of second plunger 40 and the latter, impelled by the hydraulic fluid, moves to the left, as shown in the bottom half-view of FIG. 4.

This moves the fingers of gripping means 36 to engage in slot 35 of wheelhead 22, whilst at the same time the end 43 of plunger 40 pushes rod 29 to the left, causing collet means 27 to open and withdraw from the neck portion 33 of cone 9 knob 34.

To remove wheel 10 from its mounting cone 9 merely requires moving the manouvering arm 37 back to the right, since the wheel head 22 is now gripped by arm gripping means 36.

To install a new grinding wheel the same procedure must be followed in reverse.

The end of second plunger 40 includes a pipe 50 issuing thereat, to detect the presence of the tool to be released as it obstructs the pipe's nozzle opening, and to effect regular cleaning of the mechanisms therebefore.

This sensing enables smooth machine cycling under automatic control. If no wheel is detected, the device returns to starting position and attempts a new tool pickup.

Assuming a wheel has been detected, plunger 40 thus comes into contact with spring-loaded disk 30 and presses against it until full release of the locking means.

Thus removed, wheelhead 22 can be handled without risk of being dropped.

Wheelhead 22 is placed on its receiving element on the tool handling facility and safely locked thereon.

The washers 31 push plunger 40 back midway, while the entire set of mechanisms is being air-cleaned by pipe nozzle 50. Locking of the newly installed wheelhead is detected by obstruction of the nozzle opening.

Lacking this sensor signal, the manouvering means will not be able to separate from the wheelhead 22.

Although only air-hydraulic actuators have been described herein, it should be obvious that gripping means 27 and 36 could be actuated by other means, particularly by simple manual means such as a wheel or hub puller, or some other semi-automatic device.

As for the gripping and releasing of the dresser roll cartridge, this is accomplished by the same means, including the maneuvering means described above with reference to FIG. 4.

Figure 5:
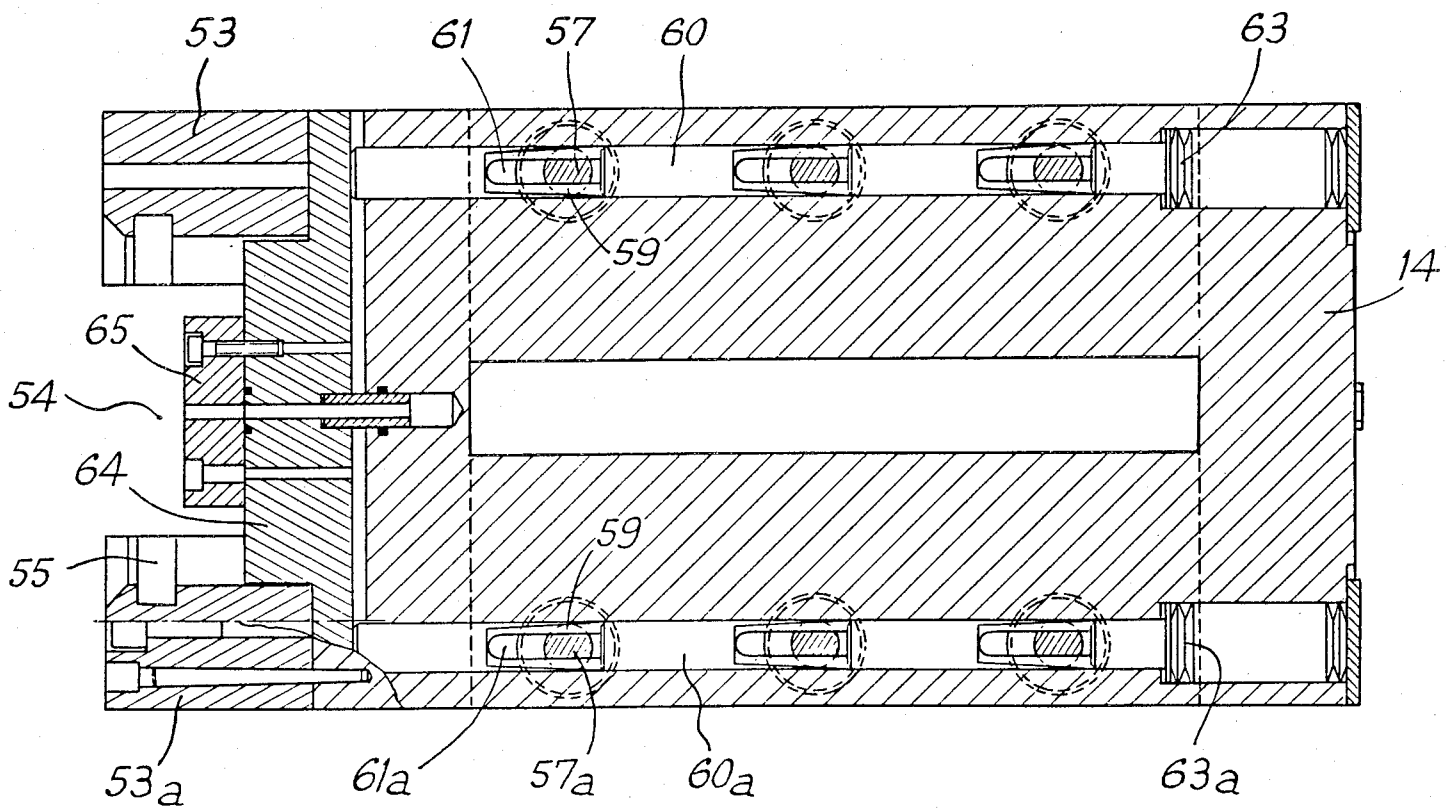
FIG. 5 is a longitudinal cross-section taken along line V—V of FIG. 3, of the cartridge-holder gripping and releasing device.

This feature, illustrated by FIGS. 2, 3 and 5, includes the cartridge 14 which is slidably mounted by two of its edges 51 in two slots 52 in the support arm 15 and is retained therein by locking means.

Cartridge 14 is continued at one end by two prongs 53 and 53*a* establishing a compartment 54 like that provided in the wheel head 22 and described hereinbefore. A slot 55 is provided in the inside wall of said compartment to receive the fingers of gripping means 36. Serrated mating parts or guide combs 56 are provided on the support 15 and the cartridge 14 to ensure correct positioning of the cartridge in arm slots of the support 15, said combs bearing against spring washers 58, 58*a* through two intervening rows of pins 57, 57*a*.

The tops of pins 57, 57*a* each have an inclined slot 59 in which are engaged the edges of two rods 60, 60*a* slidably mounted in the body of cartridge 14 in perpendicular relation to the axes of pins 57, 57*a*, said edges being bounded by oblong holes 61, 61*a* arranged in said rods and wherein are engaged pins 57, 57*a*. The edges of said oblong holes 61, 61*a* form an incline 62, such that movement of rods 60, 60*a* brings about the movement of pins 57, 57*a*, whilst compressing spring washers 58, 58*a*, thus cancelling their effect and enabling the cartridge to be freed from its support.

One end of sliding rods 60, 60*a* presses against stacked spring washers 63, 63*a*, urging the rods against the ends of a swivel plate 64 guided within the case and provided with a centered stop 65 against which the end 43 of rod 40 of the above-described manouvering means is adapted to engage.

When the cartridge 14 is mounted in its support arm 15, as in FIGS. 2, 3 and 5, pins 57, 57*a* lock it in place under the urging of springs 58, 58*a*.

To remove the cartridge, the end of the manouvering means illustrated in FIG. 4 must engage in compartment 54 such that the gripper 36 fingers become engaged in slot 55 in the opening of the compartment.

In actuating gripping means 36, plunger 40 simultaneously comes into contact, via its end 43, with the stop 65. Said stop, through swivel plate 64, pushes back the rods 60, 60*a* to the right against the uring of the spring washers 63, 63*a*. Pins 57, 57*a* are then raised by the action of rods 60, 60*a* and inclines 62, compressing spring washers 58, 58*a* to release the cartridge 14 mounted on arm 37 of the maneuvering means by gripping means 36, thus enabling removal and replacement of the cartridge by another.

To lock the new cartridge 14 in place merely requires, having engaged the edges 51 in slots 52, releasing the pressure on swivel plate 64, such that washers 63, 63*a* will push back rods 60, 60*a* to the left and inclines 62 enable movement of pins 57, 57*a* and blocking action by the spring washers 58, 58*a* on the cartridge.

As shown in FIGS. 1, 3 and 6, a balancing device 67 is provided in line with wheel 10 on the door 66 of the grinding wheel housing and fastened thereto, in a vibration isolating manner, by means of bolts 68 with intervening elastic elements 69.

The door's automatic opening thus clears away the balancing device from the wheel to be removed and in no way interferes with said changeover.

When a new tool is in place, closing door 66 reapplies balancing device 67. Said device includes an intermediate means 70 designed to engage with the tapered inlet 71 to wheelhead 22 to ensure correct centering of the device with respect to said wheelhead.

Any off-centering will be compensated by the elastic means 69, the stress applied to these accordingly ensuring the axial response $\vec{RA}$ imparted to the cone by the vibrations requiring damping $\vec{Fr}$ (radial load).

The balancing means is positively rotatively driven by pins 72 screwed into holes in wheelhead 22 and holes 73 in intermediate means 70.

Said pins 72 are retractable to avoid having to index their location with respect to the wheelhead holes. The slightest overall starting slip thus enables the pins to engage into said holes and prevent any angular offset in the unit in operation.

Obviously, the invention should not be construed as limited to the embodiments described herein, but certain modifications will occur to those skilled in the art without departing from the scope and spirit of the invention as outlined in the following claims.

What is claimed is:

1. Tool and attachment gripping and releasing means for a machine tool and in particular for a grinding machine comprising a contour grinding head whereupon are mounted a rotary spindle carrying a wheelhead and a cartridge carrying a wheel dresser roll, said machine including a maneuvering means comprising a gripping collet for engaging both said wheelhead and said cartridge to enable the removal and replacement of said wheelhead and said cartridge, and thrusting means operable to actuate said gripping means to engage said wheelhead and said cartridge, wherein said wheelhead and cartridge are provided on one of their ends with a compartment or recess having a slot adapted to be engaged by said gripping collet of said maneuvering means, and said thrusting means further operable to selectively actuate means for locking said grinding wheelhead on the machine spindle and to selectively actuate means for locking said dresser roll cartridge on a movable support.

2. Tool and attachment gripping and releasing means according to claim 1, wherein said wheelhead includes a bore providing a slot for engagement with fingers of gripping means on said maneuvering means, said bore containing collet gripping means including fingers adapted to engage a spindle in a necked portion behind a knob on the end of said spindle when so urged by spring means and adapted to disengage from said neck when so urged by a second thrusting means which compresses said spring means to open said collet, said second thrusting means being actuated by said thrusting means of said maneuvering means.

3. Tool and attachment gripping and releasing means according to claim 1, wherein said dresser roll cartridge is slidably mounted on two of its edges in two slots in a supporting means where it is retained by locking means, said cartridge including a compartment with a slot in the opening thereof adapted to be engaged by said gripping means of said maneuvering means, said compartment containing a swivel plate the center portion thereof being subjected to the action of the thrusting means of said maneuvering means and the ends thereof bearing against two rods serving to actuate said locking means.

4. Tool and attachment gripping and releasing means according to claim 3, wherein said means for locking the dresser roll cartridge onto said support consist of pins slidably mounted in perpendicular relation to said actuating rod in oblong holes therein, said rods having an inclined slot that cooperates with inclined edges of said oblong holes, said rods working against spring means that press said pins in a position of clamping with said support.

5. Tool and attachment gripping and releasing means according to claim 4, wherein serrated mating parts are placed between said pins and said support to ensure correct positioning of said cartridge.

6. Tool and attachment gripping and releasing means according to claim 1, wherein said maneuvering means consists of a moving arm containing a cylinder actuator, one end of the cylinder being fitted with a threaded collar which, together with the end of a plunger extending beyond the end of said cylinder, bounds an annular space for receiving the fingers of said gripping means which are guided therein by an incline on the end of said plunger, said plunger serving as the thrusting means to actuate the locking means for the wheelhead and dresser roll cartridge.

7. Tool and attachment gripping and releasing means according to claim 6, wherein said cylinder actuator comprises two internal chambers, a first one of said chambers receiving a first plunger both of whose faces are subjected to the action of a compressed fluid, the second one of said chambers receiving a second plunger, one end of which extends beyond the cylinder, said cylinder having a blind bore therein wherein the rod of said first plunger slides, and wherein the space between the head of said second chamber and said second plunger as well as the space in said blind bore are filled with a hydraulic fluid.

8. Tool and attachment gripping and releasing means according to claim 7, wherein a compressed air pipe is provided through a nozzle in the end of said second plunger for detecting the presence of a tool and for blow-cleaning the tool locking mechanisms.

9. Tool and attachment gripping and releasing means according to claim 1, wherein a balancing device is provided in line with the grinding wheel on a door of a wheel housing and fastened thereto by elastic means, said balancing device having a conical centering part to engage a tapered opening in the wheelhead and holes to receive pins on said wheelhead to enable positive rotational driving of said balancing device.

* * * * *